US008333248B1

(12) United States Patent
Sulzer

(10) Patent No.: US 8,333,248 B1
(45) Date of Patent: Dec. 18, 2012

(54) AUTOMATIC PITCH HOLD OF A ELECTROHYDRAULICALLY CONTROLLED RIPPER

(76) Inventor: Bryan D Sulzer, Dubuque, IA (US)

( * ) Notice: Subject to any disclaimer, the term of this patent is extended or adjusted under 35 U.S.C. 154(b) by 0 days.

(21) Appl. No.: 13/164,512

(22) Filed: Jun. 20, 2011

(51) Int. Cl.
*A01B 63/111* (2006.01)

(52) U.S. Cl. ..... 172/4

(58) Field of Classification Search ..... 37/347, 37/348; 172/2–11; 701/50; 702/96, 142, 702/143, 145, 33, 41, 44, 85; 342/70, 104, 342/106, 114; 414/111, 525.54, 549, 699, 414/789.7
See application file for complete search history.

(56) References Cited

U.S. PATENT DOCUMENTS 4,044,838 A * 8/1977 Wooldridge ..... 172/2
4,120,364 A * 10/1978 Wooldridge ..... 172/2
4,159,474 A * 6/1979 Wooldridge ..... 340/684
5,685,377 A * 11/1997 Arstein et al. ..... 172/2
5,950,141 A * 9/1999 Yamamoto et al. ..... 702/41
6,230,107 B1 * 5/2001 Yamamoto et al. ..... 702/96
6,612,375 B2 * 9/2003 Rogala ..... 172/8

* cited by examiner

*Primary Examiner* — Robert Pezzuto
(74) *Attorney, Agent, or Firm* — Stephen F. Rost; Taft, Stettinius & Hollister, LLP

(57) ABSTRACT

A ripper pitch hold system and method for a ripper that includes pitch and lift cylinders. The system includes operator pitch and lift inputs, operator pitch hold input, cylinder position inputs, and a controller. The controller processes the inputs and generates pitch and lift cylinder commands that maintain the ripper pitch angle at a pitch hold setting. The controller can update the pitch hold setting with and maintain the pitch angle at the latest operator pitch input. Alternatively, the controller can cease to process operator pitch inputs, and maintain the pitch angle at the pitch hold setting. The pitch hold input can include an activation control, and pitch selector. The pitch angle and pitch hold setting can be set to the angle selected by the pitch selector. The pitch selector can include operator adjustable and fixed pitch settings. Operator adjustable executing operator pitch commands and fixed ignoring operator pitch commands.

20 Claims, 4 Drawing Sheets

AUTOMATIC PITCH HOLD OF A ELECTROHYDRAULICALLY CONTROLLED RIPPER

FIELD OF THE INVENTION

This present invention generally relates to an automatic control system for a ripper used on construction equipment, and more specifically to automatically controlling the pitch of the ripper.

BACKGROUND OF THE INVENTION

Typically a ripper mounted on construction equipment such as a tractor is manually controlled by the operator who raises or lowers the ripper or varies the ripper pitch based upon experience, ground conditions, vehicle speed and other working conditions. In an adjustable pitch ripper carrier system, modifying the height of the ripper carrier can change the pitch of the ripper. This changes the ripping characteristics of the system while the ripper is still engaged with the underlying material. It would be desirable to hold the pitch of the ripper even during changes of the ripper depth.

SUMMARY

A system is disclosed that maintains a pitch angle of a ripper over a range of ripper heights. This can be done by measuring the length of the pitch and lift cylinders for the ripper and actuating the pitch cylinders automatically when the lift cylinder length changes to maintain the pitch angle.

An automatic pitch hold system for a ripper is disclosed for a ripper that includes a ripper pitch cylinder and a ripper lift cylinder. The ripper pitch hold system includes operator pitch and lift inputs, an operator pitch hold controller, pitch and lift cylinder sensors and a ripper electro-hydraulic controller. The operator pitch input generates an operator pitch signal for controlling the pitch angle of the ripper, and the operator lift input generates an operator lift signal for controlling the raising and lowering of the ripper. The operator pitch hold controller generates a pitch hold activation signal. The pitch cylinder sensor is coupled to the ripper pitch cylinder for sensing the position of the ripper pitch cylinder, and the pitch cylinder sensor generates a pitch cylinder position signal. The lift cylinder sensor is coupled to the ripper lift cylinder for sensing the position of the ripper lift cylinder, and lift cylinder sensor generates a lift cylinder position signal. The ripper electro-hydraulic controller processes the operator lift and pitch signals, the lift and pitch cylinder position signals and the pitch hold activation signal, and generates and outputs ripper pitch and lift cylinder commands that maintain the pitch angle of the ripper at a ripper pitch hold setting. When the pitch hold activation signal is generated, the ripper electro-hydraulic controller can process the operator pitch and lift signals updating the ripper pitch hold setting with the pitch angle of the ripper set by the latest operator pitch signal, and can maintain the pitch angle of the ripper at the latest ripper pitch hold setting. Alternatively, when the pitch hold activation signal is generated, the ripper pitch hold setting can be set to the pitch angle of the ripper, and the ripper electro-hydraulic controller can cease to process the operator pitch signals and can maintain the pitch angle of the ripper at the ripper pitch hold setting.

The operator pitch hold controller can include an activation control for generating the pitch hold activation signal, and a pitch selector for selecting a desired ripper pitch angle. When the activation control generates the pitch hold activation signal, the pitch angle of the ripper and the ripper pitch hold setting can be set to the desired ripper pitch angle selected by the ripper pitch selector, and the ripper electro-hydraulic controller can cease to process the operator pitch signals. The ripper pitch selector can include a plurality of predefined ripper pitch angle choices and a selection control for selecting the desired ripper pitch angle from the plurality of predefined ripper pitch angle choices. The ripper pitch selector can be a menu, knob, multi-position switch or other appropriate input device.

The pitch selector can include an operator adjustable pitch setting and a fixed pitch setting. When the activation control generates the pitch hold activation signal and the pitch selector selects the operator adjustable pitch setting, the pitch hold setting can be set to the current pitch angle of the ripper, and the pitch hold setting can be updated by each operator pitch signal to the pitch angle of the ripper set by the operator pitch signal. When the activation control generates the pitch hold activation signal and the pitch selector selects the fixed pitch setting, the pitch angle of the ripper and the pitch hold setting can be set to the fixed pitch setting, and the ripper electro-hydraulic controller can cease to process the operator pitch signals.

The ripper pitch cylinder commands can be output to a ripper pitch spool valve controlling the ripper pitch angle; and the ripper lift cylinder commands can be output to a ripper lift spool valve controlling the raising and lowering of the ripper. The ripper electro-hydraulic controller can include a position processor that determines a ripper position based on the pitch cylinder position signal and the lift cylinder position signal, and provides the ripper position for further processing by the ripper electro-hydraulic controller.

A ripper pitch hold method is disclosed for controlling a ripper coupled to a pitch cylinder that controls the pitch angle of the ripper and a lift cylinder that raises and lowers the ripper. The ripper pitch hold method includes activating an automatic ripper pitch hold function; setting a pitch hold setting; reading a pitch cylinder position from a pitch sensor coupled to the pitch cylinder; reading a lift cylinder position from a lift sensor coupled to the lift cylinder; receiving a ripper lift cylinder command from an operator lift control device; generating an automatic ripper pitch cylinder command for maintaining the pitch angle of the ripper at the pitch hold setting when executing the ripper lift cylinder command; executing the automatic ripper pitch cylinder command and the ripper lift command; and returning to receive another command.

The step of setting a pitch hold setting can include setting the pitch hold setting to the current pitch angle of the ripper; and the method can also include the steps of receiving an operator ripper pitch cylinder command from an operator pitch control device; determining whether the automatic ripper pitch hold function is activated; when the automatic ripper pitch hold function is activated, ignoring the operator ripper pitch cylinder command; and when the automatic ripper pitch hold function is not activated, executing the operator ripper pitch cylinder command.

The step of setting a pitch hold setting can include setting the pitch hold setting to the current pitch angle of the ripper; and the method can also include the steps of receiving an operator ripper pitch cylinder command from an operator pitch control device; determining a new pitch angle of the ripper from executing the operator ripper pitch cylinder command; updating the pitch hold setting to the new pitch angle of the ripper; and executing the operator ripper pitch cylinder command.

The step of activating an automatic ripper pitch hold function can include selecting a fixed ripper pitch hold setting; and the step of setting a pitch hold setting can include setting the pitch hold setting to the fixed ripper pitch hold setting; and the method can also include the steps of setting the pitch angle of the ripper to the fixed ripper pitch hold setting; receiving an operator ripper pitch cylinder command from an operator pitch control device; determining whether the automatic ripper pitch hold function is activated; when the automatic ripper pitch hold function is activated, ignoring the operator ripper pitch cylinder command; and when the automatic ripper pitch hold function is not activated, executing the operator ripper pitch cylinder command. The step of selecting a fixed ripper pitch hold setting can include selecting the fixed ripper pitch hold setting from a plurality of predefined pitch angles for the ripper.

The step of activating an automatic ripper pitch hold function can include selecting an adjustable ripper pitch hold setting; and the step of setting a pitch hold setting can include setting the pitch hold setting to the adjustable ripper pitch hold setting; and the method can also include the steps of setting the pitch angle of the ripper to the adjustable ripper pitch hold setting; receiving an operator ripper pitch cylinder command from an operator pitch control device; determining a new pitch angle of the ripper from executing the operator ripper pitch cylinder command; updating the pitch hold setting to the new pitch angle of the ripper; and executing the operator ripper pitch cylinder command. The step of selecting an adjustable ripper pitch hold setting can include selecting the adjustable ripper pitch hold setting from a plurality of predefined pitch angles for the ripper.

A ripper pitch hold method is disclosed for controlling a ripper coupled to a pitch cylinder that controls the pitch angle of the ripper and a lift cylinder that raises and lowers the ripper. The ripper pitch hold method includes activating an automatic ripper pitch hold function by selecting either a fixed pitch angle or an operator adjustable pitch angle; setting a pitch hold setting; reading a pitch cylinder position from a pitch sensor coupled to the pitch cylinder; reading a lift cylinder position from a lift sensor coupled to the lift cylinder; receiving an operator ripper pitch cylinder command or an operator ripper lift cylinder command from an operator control device; and determining whether the automatic ripper pitch hold function is activated. When the automatic ripper pitch hold function is not activated, then the method also includes executing the operator ripper pitch cylinder command or the operator ripper lift cylinder command; and returning to receive another command. When the automatic ripper pitch hold function is activated and an operator ripper lift cylinder command is received, then the method also includes generating an automatic ripper pitch cylinder command for maintaining the pitch angle of the ripper at the pitch hold setting when executing the operator ripper lift cylinder command; executing the automatic ripper pitch cylinder command and the operator ripper lift command; and returning to receive another command. When the automatic ripper pitch hold function is activated, and an operator ripper pitch cylinder command is received, and the fixed pitch angle is selected, then the method also includes ignoring the operator ripper pitch cylinder command; and returning to receive another command. When the automatic ripper pitch hold function is activated, and an operator ripper pitch cylinder command is received, and the operator adjustable pitch angle is selected then the method also includes determining a new pitch angle of the ripper from executing the operator ripper pitch cylinder command; updating the pitch hold setting to the new pitch angle of the ripper; executing the operator ripper pitch cylinder command; and returning to receive another command. When the fixed pitch angle is selected, the step of activating an automatic ripper pitch hold function can include setting the pitch angle of the ripper to the fixed pitch angle; and the step of setting a pitch hold setting can include setting the pitch hold setting to the fixed pitch angle. When the operator adjustable pitch angle is selected, the step of activating an automatic ripper pitch hold function can include determining the current pitch angle of the ripper; and the step of setting a pitch hold setting can include setting the pitch hold setting to the current pitch angle of the ripper.

DETAILED DESCRIPTION

Figure 1:
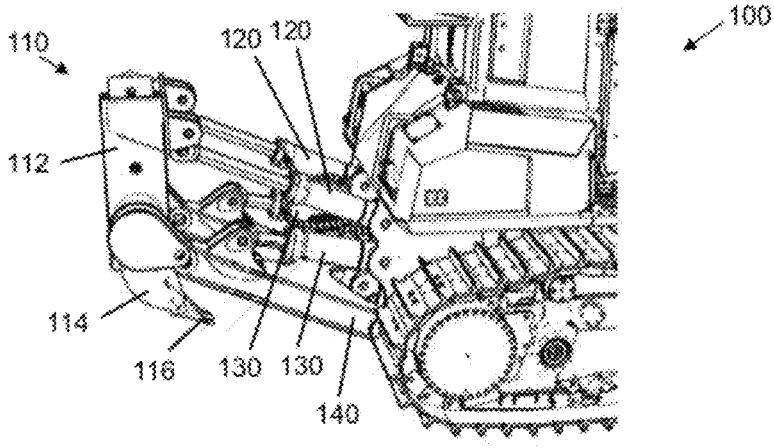
FIG. 1 illustrates an exemplary embodiment of a ripper coupled to a crawler.

For the purposes of promoting an understanding of the principles of the novel invention, reference will now be made to the embodiments described herein and illustrated in the drawings and specific language will be used to describe the same. It will nevertheless be understood that no limitation of the scope of the novel invention is thereby intended, such alterations and further modifications in the illustrated devices and methods, and such further applications of the principles of the novel invention as illustrated therein being contemplated as would normally occur to one skilled in the art to which the novel invention relates.

A system is disclosed that maintains a ripper pitch angle over a range of ripper carrier heights. This can be done by measuring the length of the pitch and lift cylinders for the ripper and actuating the pitch cylinders when the lift cylinder length changes to maintain the pitch angle of the ripper. The system can include electro-hydraulic (EH) valves, a microprocessor, an operator input device, a sensor for sensing the length of at least one of the ripper carrier lift cylinders, and a sensor for sensing the length of at least one of the ripper carrier pitch cylinders. When the operator commands a ripper lower or raise function, a function will be used based on the geometry of the system to adjust the ripper pitch cylinder to maintain a constant pitch angle relative to the crawler.

FIG. 1 illustrates an exemplary embodiment of a ripper carrier 110 coupled to a crawler 100. The ripper carrier 110 includes a shank holder 112, a ripper shank 114 with a tip 116, a pair of ripper pitch cylinders 120, a pair of ripper lift cylinders 130 and a pair of links 140. The proximal ends of the ripper pitch cylinders 120, the ripper lift cylinders 130 and the links 140 are coupled to the crawler 100 and the distal ends of the ripper pitch cylinders 120, the ripper lift cylinders 130 and the links 140 are coupled to the shank holder 112. The ripper lift cylinders 130 can be extended and retracted to raise and lower the ripper 114. The ripper pitch cylinders 120 can be extended and retracted to change the pitch angle of the ripper 114.

Figure 2:
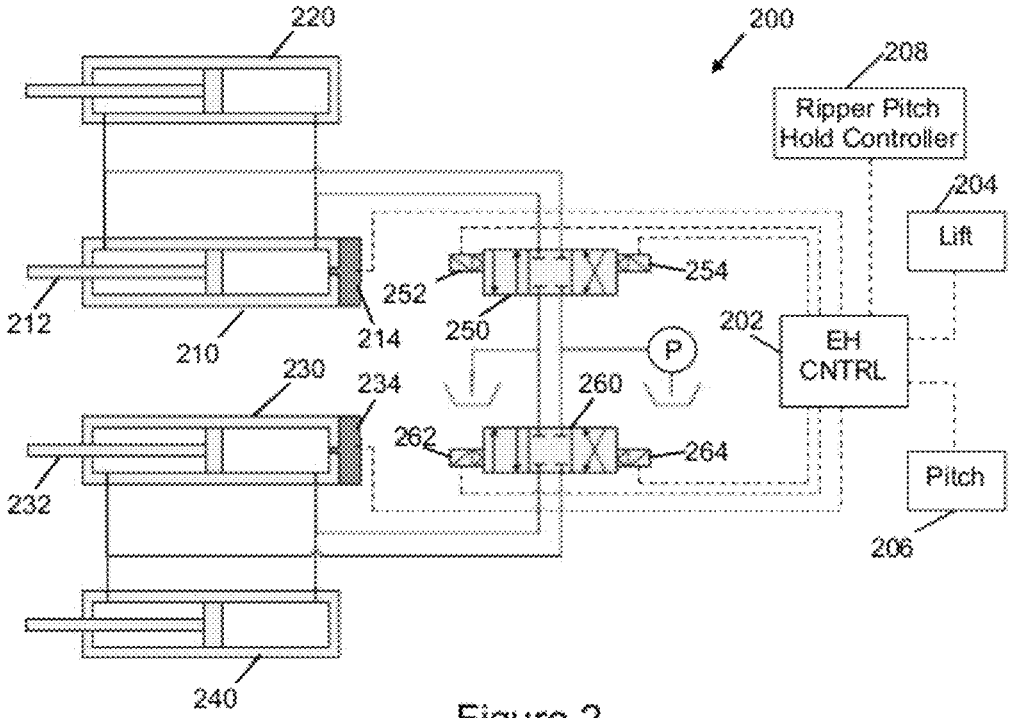
FIG. 2 illustrates an exemplary electro-hydraulic (EH) system for controlling a ripper with a ripper pitch hold controller.

FIG. 2 illustrates an exemplary electro-hydraulic (EH) system 200 for controlling a ripper. The EH system 200 includes a ripper EH controller 202, a lift spool valve 250, a pitch spool valve 260, a pair of lift cylinders 210, 220, a pair of pitch cylinders 230, 240, a flow source P and a sink. The ripper EH controller 202 receives operator and system inputs and generates output signals to control the spool valves and cylinders.

The ripper EH controller 202 receives operator inputs from a ripper lift controller 204, a ripper pitch controller 206 and a ripper pitch hold controller 208. The ripper lift and pitch controllers 204, 206 can be any of various types of controllers known in the art, for example a single joystick for both lift and pitch control, or separate joysticks for each of lift and pitch control. The ripper pitch hold controller 208 can also be of various types of controllers, for example a switch, knob, button, menu, etc. The ripper EH controller 202 processes the operator inputs to control the ripper.

At least one of the ripper lift cylinders 210, 220 has a lift cylinder position sensor 214. The lift cylinder position sensor 214 senses the position of the piston 212 in the lift cylinder 210 and sends a sensor output to the ripper EH controller 202. The ripper EH controller 202 can use the output of the lift cylinder position sensor 214 to determine the position of the ripper relative to the main geometry of the tractor.

At least one of the ripper pitch cylinders 230, 240 has a pitch cylinder position sensor 234. The pitch cylinder position sensor 234 senses the position of the piston 232 in the pitch cylinder 230 and sends a sensor output to the ripper EH controller 202. The ripper EH controller 202 can use the output of the pitch cylinder position sensor 234 to determine the pitch and position of the ripper relative to the main geometry of the tractor.

The ripper EH controller 202 processes the operator and sensor inputs and sends control signals to the lift spool valve 250 and the pitch spool valve 260. The lift spool valve 250 includes a first movement actuator 252 and a second movement actuator 254 to move the lift spool valve 250 to a desired position. The lift spool valve 250 also includes an input side (bottom) coupled to a flow source P, for example a pump, and an output side (top) coupled to the lift cylinders 210, 220. The first movement actuator 252 can be used to move the lift spool valve 250 to retract the lift cylinders 210, 220. The second movement actuator 254 can be used to move the lift spool valve 250 to extend the lift cylinders 210, 220.

The pitch spool valve 260 includes a first movement actuator 262 and a second movement actuator 264 to move the pitch spool valve 260 to a desired position. The pitch spool valve 260 also includes an input side (top) coupled to a flow source P, for example a pump, and an output side (bottom) coupled to the pitch cylinders 230, 240. The first movement actuator 262 can be used to move the pitch spool valve 260 to retract the pitch cylinders 230, 240. The second movement actuator 264 can be used to move the pitch spool valve 260 to extend the pitch cylinders 230, 240.

Figure 3:
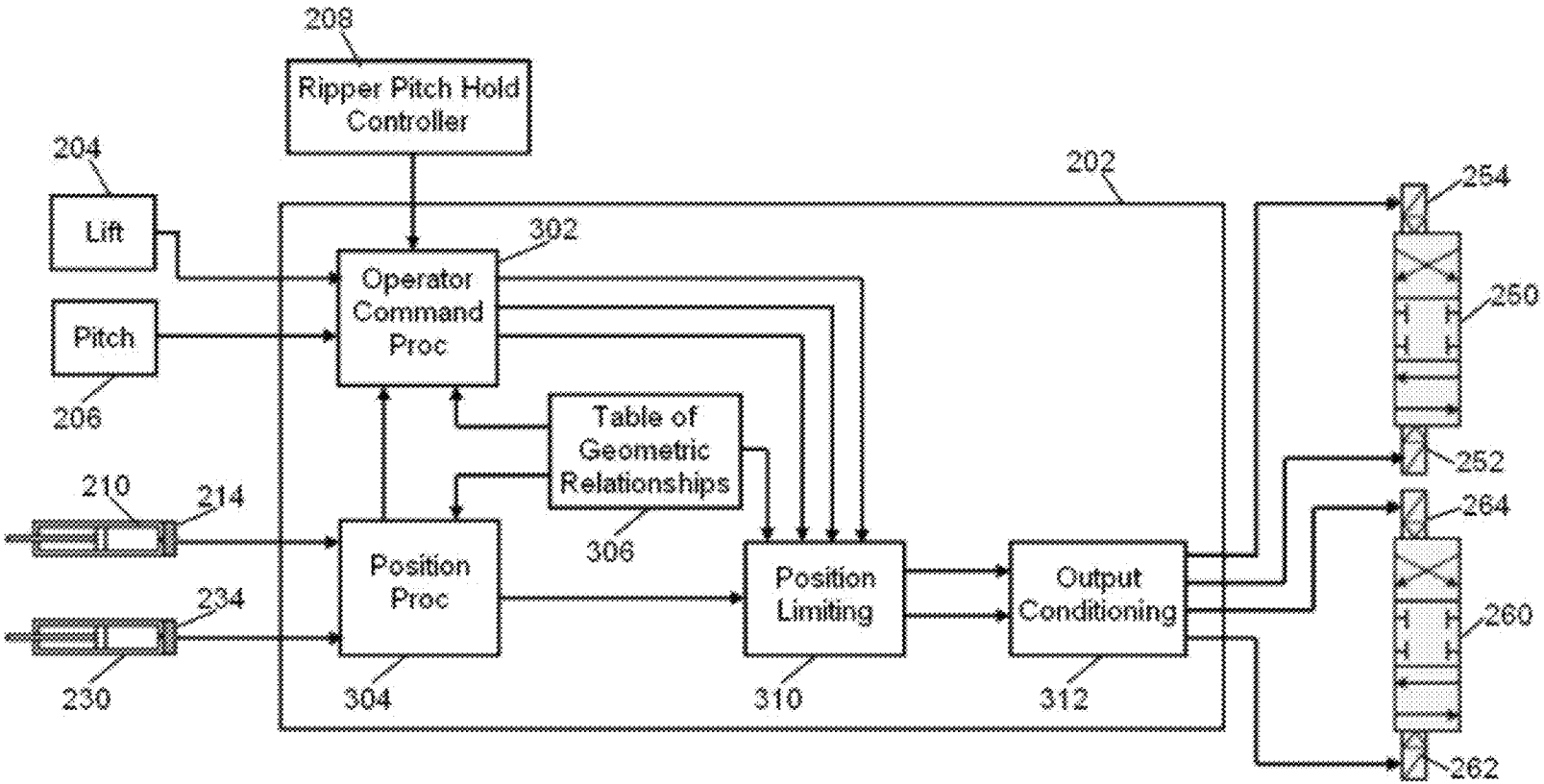
FIG. 3 illustrates a more detailed view of an exemplary embodiment of the EH controller of FIG. 2.

FIG. 3 illustrates a more detailed view of an exemplary embodiment of the ripper EH controller 202. The ripper EH controller 202 includes a table of geometric relationships 306 which can be used to determine ripper pitch and position relative to the tractor based on system parameters including ripper lift and pitch cylinder positions. The inputs from the lift cylinder position sensor 214 and the pitch cylinder position sensor 234 are processed by a cylinder position processor 304 which also uses the table of geometric relationships 306 to determine ripper position and pitch data. The ripper position and pitch data computed by the position processor 304 is sent to an operator command processor 302 and to a position limiting processor 310.

The operator command processor 302 processes the ripper position and pitch data generated by the position processor 304, along with the inputs from the operator lift, pitch and pitch hold controllers 204, 206, 208, and the table of geometric relationships 306 to generate lift and pitch cylinder commands, and pitch hold commands. The lift and pitch cylinder commands, and the pitch hold signals are sent to the position limiting processor 310.

The position limiting processor 310 processes the inputs from the operator command processor 302 and the position processor 304, and uses the table of geometric relationships 306 to determine lift and pitch cylinder commands to send to an output conditioning processor 312. If the ripper pitch hold option is active, the position limiting processor 310 may have to revise the input commands from the operator command processor 302 before sending them to the output conditioning processor 312.

In one exemplary embodiment, automatic operator adjustable pitch hold, the operator can set the ripper pitch to a desired pitch position and the system will maintain that pitch when ripper lift commands are made using the lift controller 204. In this embodiment, when the operator changes the ripper pitch angle using the pitch controller 206, then the system executes the pitch command and sets the new pitch angle as the pitch angle to be maintained. For example the operator could initially set the ripper pitch angle to 12 degrees and maintain this pitch while raising and lowering the ripper, then change the ripper pitch angle to 15 degrees using the pitch controller 206 and maintain this new pitch while raising and lowering the ripper.

In another exemplary embodiment, automatic fixed pitch hold function, the operator can set the ripper pitch to a desired pitch position and the system will maintain that pitch angle when ripper commands are made using the lift or pitch controllers 204, 206. In this embodiment, when the pitch controller 206 is moved to change the ripper pitch angle, the system does not execute the pitch command and maintains the ripper pitch angle at the previously set pitch angle. For example, the operator could set the pitch hold angle at 12 degrees because it is the optimal pitch for ripping a certain material and maintain this pitch while raising and lowering the ripper, and if the pitch controller 206 is inadvertently moved, the system will ignore the pitch command and maintain the 12 degree pitch angle. Of course, using the pitch hold controller 208, the operator can turn off the fixed pitch hold option or set a new pitch angle to replace the 12 degree angle and the system will maintain the new pitch angle.

The two embodiments of the pitch hold function described above can be combined in a single system. For example, the ripper pitch hold selector 208 can include a selector switch, button, menu etc. where the operator can select the mode for automatic pitch hold: an operator adjustable mode to hold the ripper pitch angle for ripper lift commands and change the pitch for ripper pitch commands, and a fixed mode to hold the ripper pitch angle for either ripper lift or pitch commands.

The output conditioning processor 312 sends commands received from the position limiting processor 310 to the lift spool valve 250 and the pitch spool valve 260. The output conditioning processor 312 sends lift commands to the movement actuators 252, 254 to position the lift spool valve 250 and control the lift cylinders 210, 220. The output conditioning processor 312 sends pitch commands to the movement actuators 262, 264 to position the pitch spool valve 260 and control the pitch cylinders 230, 240.

Figure 4:
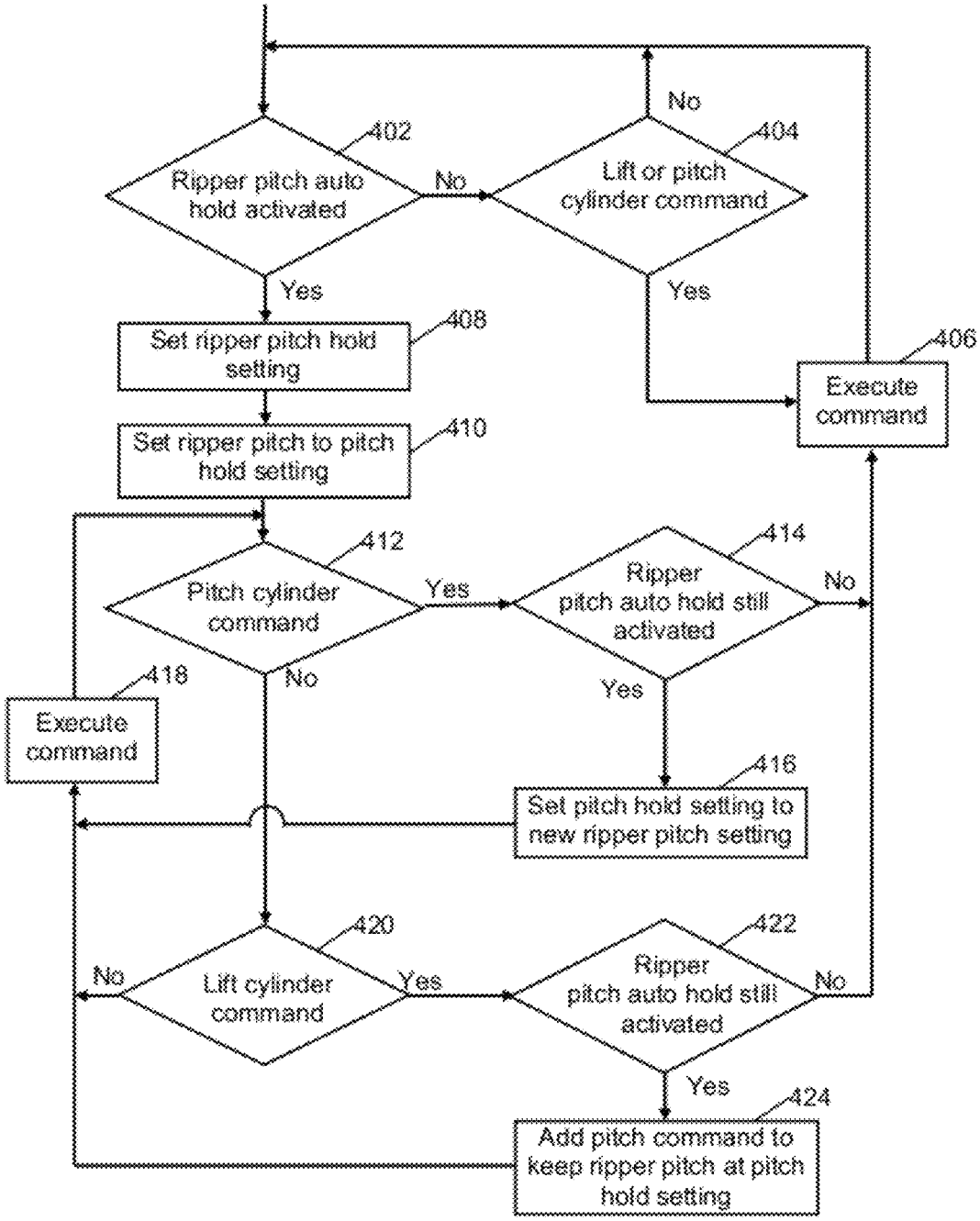
FIG. 4 is a flow diagram of an exemplary implementation of a control process for an automatic ripper pitch hold function where the system holds the ripper pitch angle for ripper lift commands, and changes the ripper pitch angle as commanded for ripper pitch commands.

FIG. 4 is a flow diagram of an exemplary implementation of a control process for an automatic ripper pitch hold function where the system holds the ripper pitch angle for ripper lift commands, and changes the ripper pitch angle as commanded for ripper pitch commands. When a command is processed, at block 402 the system checks if the ripper pitch automatic hold option is activated. If the ripper pitch automatic hold option is activated then control is passed to block 408, otherwise control is passed to block 404. At block 404, the system checks if the command is a lift or pitch cylinder command. If the command is a lift or pitch cylinder command then control is passed to block 406, otherwise the system returns to process the next command. At block 406, the system executes the lift or pitch cylinder command and then returns to process the next command.

If the ripper pitch automatic hold function is activated, then at block 408 the system sets the ripper pitch hold setting, and then at block 410 the system sets the ripper pitch to the ripper pitch hold setting, and the control passes to block 412.

At block 412 the system waits for the next command. When a command is received, at block 412 the system checks if it is a pitch cylinder command. If the command is a pitch cylinder command, control passes to block 414, otherwise control passes to block 420. At block 414 the system checks if the ripper pitch hold option is still activated. If the ripper pitch hold option is not still activated then at step 406 the pitch cylinder command is executed and control is passed back to block 402 to wait for the ripper pitch hold option to be activated again. If the ripper pitch hold option is still activated then control is passed to block 416. At block 416 the system sets the ripper pitch hold setting to the new ripper pitch setting and control passes to block 418. At block 418 the pitch cylinder command is executed and control is passed back to block 412 to wait for the next command.

At block 420 the system checks if the command is a lift cylinder command. If the command is a lift cylinder command, control passes to block 422, otherwise control passes to block 418. At block 418 the command is executed and control is passed back to block 412 to wait for the next command.

At block 422 the system checks if the ripper pitch hold option is still activated. If the ripper pitch hold option is not still activated then at step 406 the lift cylinder command is executed and control is passed back to block 402 to wait for the ripper pitch hold option to be activated again. If the ripper pitch hold option is still activated then control is passed to block 424. At block 424 the system generates a pitch command to keep the ripper pitch at the pitch hold setting and control passes to block 418. At block 418 the lift and pitch cylinder commands are executed and control is passed back to block 412 to wait for the next command.

Figure 5:
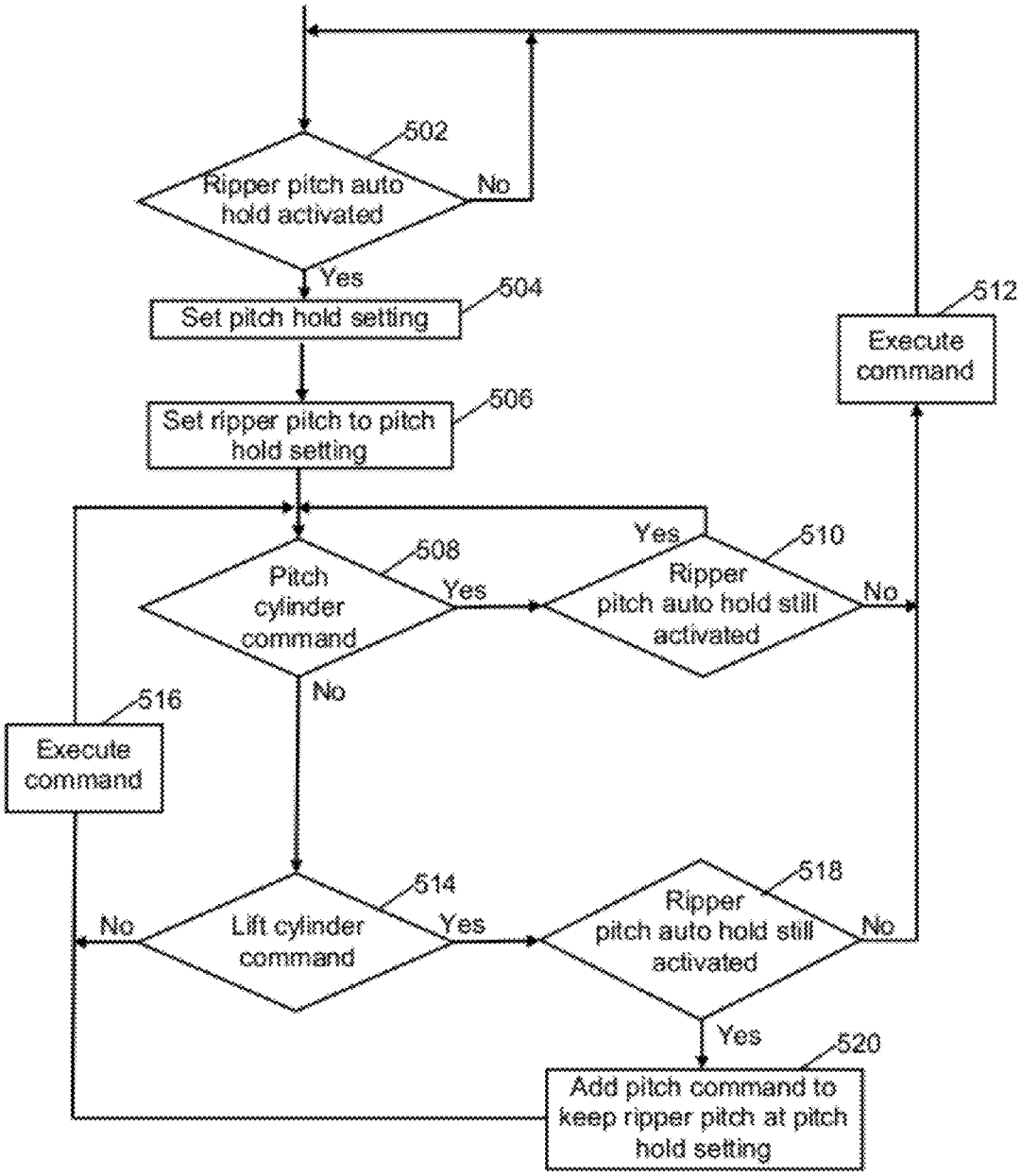
FIG. 5 is a flow diagram of an exemplary implementation of a control process for an automatic ripper pitch hold function where the system holds the ripper pitch angle for ripper lift and pitch commands, effectively ignoring the ripper pitch commands while the automatic ripper pitch hold function is activated.

FIG. 5 is a flow diagram of an exemplary implementation of a control process for an automatic ripper pitch hold function where the system holds the ripper pitch angle for ripper lift and pitch commands, effectively ignoring the ripper pitch commands while the automatic ripper pitch hold function is activated. When a command is processed, at block 502 the system checks if the automatic ripper pitch hold function is activated. If the ripper pitch hold function is activated then control is passed to block 504, otherwise the system returns to process the next command.

If the ripper pitch hold option is activated, then at block 504 the system sets the ripper pitch hold setting, then at block 506 the system sets the ripper pitch to the ripper pitch hold setting, and control passes to block 508.

At block 508 the system waits for a command. When a command is received, at block 508 the system checks if the command is a ripper pitch cylinder command. If the command is a ripper pitch cylinder command then control passes to block 510, otherwise control passes to block 514. At block 510 the system checks if the ripper pitch hold option is still activated. If the ripper pitch hold option is not still activated then at step 512 the ripper pitch cylinder command is executed and control is passed back to block 502 to wait for the pitch hold option to be activated again. If the ripper pitch hold option is still activated then the pitch command is not executed and control is passed back to block 508 to wait for the next command.

At block 514 the system checks if the command is a ripper lift cylinder command. If the command is a ripper lift cylinder command then control passes to block 518, otherwise control passes to block 516. At block 516, the command is executed and control passes back to block 508 to wait for the next command.

At block 518 the system checks if the ripper pitch hold option is still activated. If the ripper pitch hold option is not still activated then at step 512 the ripper lift cylinder command is executed and control is passed back to block 502 to wait for the pitch hold option to be activated again. If the ripper pitch hold option is still activated then at block 520 the system generates a pitch command to keep the ripper pitch at the pitch hold setting and control passes to block 516. At block 516 the lift and pitch cylinder commands are executed and control is passed back to block 508 to wait for the next command.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains.

I claim:

1. An automatic pitch hold system for a ripper that includes a ripper pitch cylinder and a ripper lift cylinder, the ripper pitch hold system comprising:

an operator pitch input generating an operator pitch signal for controlling the pitch angle of the ripper;

an operator lift input generating an operator lift signal for controlling the raising and lowering of the ripper;

an operator pitch hold controller for generating a pitch hold activation signal to maintain the pitch angle of the ripper at a ripper pitch angle hold setting;

a pitch cylinder sensor coupled to the ripper pitch cylinder for sensing the position of the ripper pitch cylinder and generating a pitch cylinder position signal;

a lift cylinder sensor coupled to the ripper lift cylinder for sensing the position of the ripper lift cylinder and generating a lift cylinder position signal; and a ripper electro-hydraulic controller for processing the operator lift and pitch signals, the lift and pitch cylinder position signals and the pitch hold activation signal, and when the pitch hold activation signal is activated for generating and outputting ripper pitch and lift cylinder commands that maintain the pitch angle of the ripper at the ripper pitch angle hold setting while raising or lowering the ripper based on the operator lift signal.

2. The automatic pitch hold system of claim 1, wherein when the pitch hold activation signal is generated, the ripper electro-hydraulic controller processes the operator pitch and lift signals updating the ripper pitch angle hold setting with the pitch angle of the ripper set by the latest operator pitch signal, and maintaining the pitch angle of the ripper at the latest ripper pitch angle hold setting while raising or lowering the ripper based on the operator lift signal.

3. The automatic pitch hold system of claim 1, wherein when the pitch hold activation signal is generated, the ripper pitch angle hold setting is set to the pitch angle of the ripper, and the ripper electro-hydraulic controller ceases to process the operator pitch signals and maintains the pitch angle of the ripper at the ripper pitch angle hold setting while raising or lowering the ripper based on the operator lift signal.

4. The automatic pitch hold system of claim 1, wherein the operator pitch hold controller comprises an activation control for generating the pitch hold activation signal, and a pitch selector for selecting a desired ripper pitch angle.

5. The automatic pitch hold system of claim 4, wherein when the activation control generates the pitch hold activation signal, the pitch angle of the ripper and the ripper pitch angle hold setting are set to the desired ripper pitch angle selected by the ripper pitch selector, and the ripper electro-hydraulic controller ceases to process the operator pitch signals and maintains the pitch angle of the ripper at the desired ripper pitch angle selected by the pitch selector while raising or lowering the ripper based on the operator lift signal.

6. The automatic pitch hold system of claim 5, wherein the ripper pitch selector comprises a plurality of predefined ripper pitch angle choices and a selection control for selecting the desired ripper pitch angle from the plurality of predefined ripper pitch angle choices.

7. The automatic pitch hold system of claim 6, wherein the ripper pitch selector is a menu, knob or multi-position switch.

8. The automatic pitch hold system of claim 4, wherein the pitch selector includes an operator adjustable pitch setting and a fixed pitch setting, wherein when the activation control generates the pitch hold activation signal and the pitch selector selects the operator adjustable pitch setting, the ripper pitch angle hold setting is set to the current pitch angle of the ripper, and the ripper pitch angle hold setting is updated by each operator pitch signal to the pitch angle of the ripper set by the operator pitch signal, and the ripper electro-hydraulic controller maintains the pitch angle of the ripper at the latest ripper pitch angle hold setting while raising or lowering the ripper based on the operator lift signal; and when the activation control generates the pitch hold activation signal and the pitch selector selects the fixed pitch setting, the pitch angle of the ripper and the ripper pitch angle hold setting are set to the desired ripper pitch angle selected by the pitch selector, and the ripper electro-hydraulic controller ceases to process the operator pitch signals and maintains the pitch angle of the ripper at the desired ripper pitch angle selected by the pitch selector while raising or lowering the ripper based on the operator lift signal.

9. The automatic pitch hold system of claim 1, wherein the ripper pitch cylinder commands are output to a ripper pitch spool valve controlling the ripper pitch angle; and wherein the ripper lift cylinder commands are output to a ripper lift spool valve controlling the raising and lowering of the ripper.

10. The automatic pitch hold system of claim 1, wherein the ripper electro-hydraulic controller further comprises a position processor for determining a ripper position based on the pitch cylinder position signal and the lift cylinder position signal, and providing the ripper position for further processing by the ripper electro-hydraulic controller.

11. A ripper pitch hold method for controlling a ripper coupled to a pitch cylinder that controls the pitch angle of the ripper and a lift cylinder that raises and lowers the ripper, the ripper pitch hold method comprising:

activating an automatic ripper pitch hold function;

setting a pitch hold setting defining a ripper pitch angle to be maintained regardless of the raising and lowering of the ripper;

reading a pitch cylinder position from a pitch sensor coupled to the pitch cylinder;

reading a lift cylinder position from a lift sensor coupled to the lift cylinder;

receiving a ripper lift cylinder command from an operator lift control device;

generating an automatic ripper pitch cylinder command for maintaining the pitch angle of the ripper at the pitch hold setting when executing the ripper lift cylinder command;

executing the automatic ripper pitch cylinder command and the ripper lift command; and returning to receive another command.

12. The ripper pitch hold method of claim 11, wherein setting a pitch hold setting comprises setting the pitch hold setting to the current pitch angle of the ripper; and the method further comprises:

receiving an operator ripper pitch cylinder command from an operator pitch control device;

determining whether the automatic ripper pitch hold function is activated;

when the automatic ripper pitch hold function is activated, ignoring the operator ripper pitch cylinder command; and when the automatic ripper pitch hold function is not activated, executing the operator ripper pitch cylinder command.

13. The ripper pitch hold method of claim 11, wherein setting a pitch hold setting comprises setting the pitch hold setting to the current pitch angle of the ripper; and the method further comprises:

receiving an operator ripper pitch cylinder command from an operator pitch control device;

determining a new pitch angle of the ripper from executing the operator ripper pitch cylinder command;

updating the pitch hold setting to the new pitch angle of the ripper; and executing the operator ripper pitch cylinder command.

14. The ripper pitch hold method of claim 11, wherein activating an automatic ripper pitch hold function comprises selecting a fixed ripper pitch hold setting;

setting a pitch hold setting comprises setting the pitch hold setting to the fixed ripper pitch hold setting; and the method further comprises:

setting the pitch angle of the ripper to the fixed ripper pitch hold setting;

receiving an operator ripper pitch cylinder command from an operator pitch control device;

determining whether the automatic ripper pitch hold function is activated;

when the automatic ripper pitch hold function is activated, ignoring the operator ripper pitch cylinder command; and when the automatic ripper pitch hold function is not activated, executing the operator ripper pitch cylinder command.

15. The ripper pitch hold method of claim 14, wherein selecting a fixed ripper pitch hold setting comprises selecting the fixed ripper pitch hold setting from a plurality of predefined pitch angles for the ripper.

16. The ripper pitch hold method of claim 11, wherein activating an automatic ripper pitch hold function comprises selecting an adjustable ripper pitch hold setting;

setting a pitch hold setting comprises setting the pitch hold setting to the adjustable ripper pitch hold setting; and the method further comprises:

setting the pitch angle of the ripper to the adjustable ripper pitch hold setting;

receiving an operator ripper pitch cylinder command from an operator pitch control device;

determining a new pitch angle of the ripper from executing the operator ripper pitch cylinder command;

updating the pitch hold setting to the new pitch angle of the ripper; and executing the operator ripper pitch cylinder command.

17. The ripper pitch hold method of claim 16, wherein selecting an adjustable ripper pitch hold setting comprises selecting the adjustable ripper pitch hold setting from a plurality of predefined pitch angles for the ripper.

18. A ripper pitch hold method for controlling a ripper coupled to a pitch cylinder that controls the pitch angle of the ripper and a lift cylinder that raises and lowers the ripper, the ripper pitch hold method comprising:

activating an automatic ripper pitch hold function by selecting either a fixed pitch angle or an operator adjustable pitch angle;

setting a pitch hold setting defining a ripper pitch angle to be maintained regardless of the raising and lowering of the ripper;

reading a pitch cylinder position from a pitch sensor coupled to the pitch cylinder;

reading a lift cylinder position from a lift sensor coupled to the lift cylinder;

receiving an operator ripper pitch cylinder command or an operator ripper lift cylinder command from an operator control device;

determining whether the automatic ripper pitch hold function is activated;

when the automatic ripper pitch hold function is not activated, then:

executing the operator ripper pitch cylinder command or the operator ripper lift cylinder command;

and returning to receive another command;

when the automatic ripper pitch hold function is activated, then when an operator ripper lift cylinder command is received:

generating an automatic ripper pitch cylinder command for maintaining the pitch angle of the ripper at the pitch hold setting when executing the operator ripper lift cylinder command;

executing the automatic ripper pitch cylinder command and the operator ripper lift command; and returning to receive another command;

when the automatic ripper pitch hold function is activated, then when an operator ripper pitch cylinder command is received and the fixed pitch angle is selected:

ignoring the operator ripper pitch cylinder command; and returning to receive another command; and when the automatic ripper pitch hold function is activated, then when an operator ripper pitch cylinder command is received and the operator adjustable pitch angle is selected:

determining a new pitch angle of the ripper from executing the operator ripper pitch cylinder command;

updating the pitch hold setting to the new pitch angle of the ripper;

executing the operator ripper pitch cylinder command; and returning to receive another command.

19. The ripper pitch hold method of claim 18, wherein when the fixed pitch angle is selected, the activating an automatic ripper pitch hold function comprises setting the pitch angle of the ripper to the fixed pitch angle; and the setting a pitch hold setting comprises setting the pitch hold setting to the fixed pitch angle.

20. The ripper pitch hold method of claim 18, wherein when the operator adjustable pitch angle is selected, the activating an automatic ripper pitch hold function comprises determining the current pitch angle of the ripper; and the setting a pitch hold setting comprises setting the pitch hold setting to the current pitch angle of the ripper.

* * * * *

UNITED STATES PATENT AND TRADEMARK OFFICE

CERTIFICATE OF CORRECTION

PATENT NO. : 8,333,248 B1
APPLICATION NO. : 13/164512
DATED : December 18, 2012
INVENTOR(S) : Bryan D. Selzer It is certified that error appears in the above-identified patent and that said Letters Patent is hereby corrected as shown below:

Title Page

Change Inventor: Bryan D Selzer to Bryan D. Selzer

ADD: Assignee: Deere & Company

Signed and Sealed this
Second Day of April, 2013

Teresa Stanek Rea
*Acting Director of the United States Patent and Trademark Office*